US005990838A

United States Patent [19]

Burns et al.

[11] Patent Number: 5,990,838

[45] **Date of Patent: *Nov. 23, 1999**

[54] DUAL ORTHOGONAL MONOPOLE ANTENNA SYSTEM

[75] Inventors: Lawrence M. Burns, Mountain View; Chong L. Woo, Sunnyvale, both of Calif.

[73] Assignee: 3Com Corporation, Santa Clara, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/660,964

[22] Filed: Jun. 12, 1996

[51] Int. Cl.[6] ..... H01Q 1/38

[52] U.S. Cl. ..... 343/702; 343/795; 343/829; 343/841; 343/846

[58] Field of Search ..... 343/702, 795, 343/797, 700 MS, 778, 841, 829, 846; H01Q 1/38, 13/08

[56] References Cited

U.S. PATENT DOCUMENTS

| | | | |
|---|---|---|---|
| 3,798,548 | 3/1974 | White et al. | 325/309 |
| 3,803,617 | 4/1974 | Fletcher et al. | 343/797 |
| 4,072,951 | 2/1978 | Kaloi | 343/700 MS |
| 4,371,877 | 2/1983 | Doussot et al. | 343/770 |
| 4,761,822 | 8/1988 | Maile | 455/82 |
| 4,792,810 | 12/1988 | Fukuzawa et al. | 343/700 MS |
| 4,814,882 | 3/1989 | Nuimura | 358/181 |

(List continued on next page.)

FOREIGN PATENT DOCUMENTS

| | | | |
|---|---|---|---|
| 2048571 | 12/1980 | United Kingdom | 343/797 |

OTHER PUBLICATIONS

Adachi, Fumiyuki, "Selection and Scanning Diversity Effects in a Digital FM Land Mobile Radio With Limiter Discriminator Detection," TNAS. IECE of Japan, vol. 64–E, pp. 398–405, Jun. 6, 1981.

Adachi, et al., "Unified Analysis of Postdetection Diversity for Binary Digital FM Mobile Radio," IEEE Transactions on Vehicular Technology, vol. 37, No. 4, pp. 189–198, Nov. 1988.

Feher, Kamilo, "Diversity Techniques for Mobile–Wireless Radio Systems," Wireless Digital Communication—Modulation and Spread Spectrum Applications, Ch. 7, pp. 333–340 (1995).

Parsons, et al., "Single–Receiver Diversity Systems," IEEE Transactions on Communications, vol. Com–21, pp. 1276–1280, Nov. 1973.

Parsons, et al., "Mobile Communication Systems," Halsted Press, pp. 189–243, (1989).

Villard, Jr., et al., "A Mode–Averaging Diversity Combiner," IEEE Transactions on Antennas and Propagation, vol. AP–20, No. 4, pp. 463–469, Jul. 1972.

*Primary Examiner*—Michael C. Wimer

*Attorney, Agent, or Firm*—Wilson Sonsini Goodrich & Rosati

[57] ABSTRACT

An antenna system for use in wireless communication systems that is based on a pair of monopole antennas, which are electrically isolated from each other and arranged generally orthogonally. A feed circuit is coupled to the first and second monopole antennas, which connects them to a host system. Also, a ground plane conductor extends generally between the feeds for the first and second monopole antennas to improve isolation. The monopole antennas are formed on a printed circuit board, formed on first and second dielectric layers. A ground plane conductive film is disposed between the dielectric layers. The first monopole antenna is formed on an outside surface of the first dielectric layer, and the second monopole antenna is formed on the outside surface of the second dielectric layer. The second monopole antenna is arranged generally orthogonally to the first monopole antenna. The first and second monopole antennas comprise impedance matched microstrips, and the feed circuit comprises a first impedance matched unbalanced line coupled to the first monopole antenna, and a second impedance matched unbalanced line coupled to the second monopole antenna.

45 Claims, 8 Drawing Sheets

U.S. PATENT DOCUMENTS

| | | | |
|---|---|---|---|
| 4,969,211 | 11/1990 | Raymond | 455/277 |
| 4,983,987 | 1/1991 | Woloszczuk | 343/797 |
| 5,061,944 | 10/1991 | Powers et al. | 343/795 |
| 5,164,942 | 11/1992 | Kamerman et al. | 370/94.1 |
| 5,276,920 | 1/1994 | Kuisma | 455/101 |
| 5,335,010 | 8/1994 | Lindemeier et al. | 343/876 |
| 5,394,160 | 2/1995 | Iwasaki et al. | 343/841 |
| 5,507,035 | 4/1996 | Bantz et al. | 455/133 |
| 5,525,967 | 6/1996 | Azizi et al. | 340/573 |
| 5,548,834 | 8/1996 | Suard et al. | 455/276.1 |

TOP VIEW

BOTTOM VIEW

DUAL ORTHOGONAL MONOPOLE ANTENNA SYSTEM

CROSS REFERENCE TO RELATED APPLICATION

The present invention is related to co-pending U.S. patent application Ser. No. 08/660,985, invented by Lawrence W. Burns, entitled ANTENNA SCANNING SYSTEM WITH LOW FREQUENCY DITHERING, filed on the same day as the present application, and owned at the time of invention and currently by the same assignee, now U.S. Pat. No. 5,835,855.

BACKGROUND OF THE INVENTION

1. Field of the Invention

The present invention relates to antenna systems for wireless communication devices, and more particularly to a simplified, low cost antenna system providing spatial diversity to combat multipath effects in communication systems.

2. Description of Related Art

In most wireless systems it is necessary to employ some form of antenna diversity to combat multipath effects in the communication system. The antenna diversity can be accomplished in the form of frequency diversity, time diversity, or spatial diversity. In frequency diversity, the system switches between frequencies to combat multipath interference. In the time diversity systems, the signal is transmitted or received at two different times, which works well in a rapidly changing environment. In spatial diversity systems, two or more antennas are placed at physically different locations combat multipath interference. The spatial diversity approach is probably the most common technique.

Many prior art systems in the 2.4 GHz ISM communications bands use a pair of ceramic patch antennas to form a spatially diverse antenna configuration. As shown in FIG. 1, a ceramic patch antenna comprises a ceramic substrate 10, a metalized patch 11 formed on one surface of the substrate 10, and a bottom side ground plane 13. A feed hole 12 couples the metalized patch 11 to the receiver/transmitter using the antenna as shown in FIG. 2. FIG. 2 is a side view of the ceramic patch antenna showing the metalized patch 11, the ceramic substrate 10, and the bottom ground plane 13. The feed hole 12 includes a solder fillet 14, connecting to a center wire of a coaxial cable 15, and also includes a solder fillet 16 which is coupled to the ground plane 13 and the shield of the coaxial cable 15. The use of high dielectric constant materials for the ceramic substrate 10 results in a set of antenna that are physically small. However, ceramic patch antennas tend to be relatively expensive. Furthermore, connecting the antenna to a low cost circuit board often requires special connectors and cabling, which also add cost to the system.

In addition, the ceramic patch antennas relying on high dielectric constant materials have a very high Q. This makes the antenna narrow band, and subject to manufacturing variations, and hence yield losses. Lastly, the patch antennas are directive with maximum radiation perpendicular to the face of the patch itself, with a null perpendicular to the ground plane. Having gain directivity is fine for locations where many patches can be used to cover all angles. However, it is best avoided in remote units where orientation of the antenna cannot be controlled.

One way to avoid the use of ceramic antennas is to fabricate the antenna on the same printed circuit board as the electronics. However, the board material has a much lower dielectric constant than ceramic, resulting in physically large antennas. Also, the configuration results in a difficult RF feed configuration, since the input of the antenna is on the bottom in the middle of the ground plane, making it difficult to connect a 50 ohm trace or other matched impedance lead, to the bottom side without breaking continuity on the ground plane.

An alternative which partially eliminates the feed arrangement problem is a printed dipole antenna on the board. One prior art example is shown in FIG. 3. The printed dipole includes first dipole element 20, a second dipole element 21, which are arranged to establish an antenna length $\lambda/2$, where $\lambda$ is the wavelength of the nominal center frequency for the antenna in free space. A balun 23 is required to implement an optimal feed arrangement between a 50 ohm unbalanced line 24, and the 75 ohm balanced dipole connection. The dipole antenna system is fabricated on the printed circuit board 25. The unbalanced 50 ohm line 24 is coupled to the transmitter power amplifier or into the receiver.

Another alternative in the prior art is to use physically small monopoles on the printed circuit board itself, even though prior art systems have not been matched for a 50 ohm standard feed. This approach requires a matching circuit which has a high Q. A high Q of the matching circuit results in a narrower bandwidth, as well as additional losses in the matching circuit itself.

Thus, the objects of a wireless antenna arrangement include the following:

1) The antennas are physically small.

2) The antenna can be fabricated on the same low cost circuit board as the rest of the electronics.

3) The bandwidth of the antenna is wide enough so that manufacturing tolerances will not cause degradation in performance.

4) The antenna is matched to 50 ohms so that the matching circuits are not required.

5) The feed for each antenna is a 50 ohm unbalanced line.

6) The antennas in the system are electrically isolated from each other, so that true spatial diversity can be achieved.

SUMMARY OF THE INVENTION

The present invention provides an antenna system suitable for use in wireless communication systems which achieves the objectives outlined above. The antenna system is based on a pair of monopole antennas, which are electrically isolated from each other and are arranged generally orthogonally. A feed circuit is coupled to the first and second monopole antennas, which connects them to a host system. Also, a ground plane conductor extends generally between the feed circuits for first and second monopole antennas to improve isolation.

The monopole antennas according to one aspect of the invention are formed on a printed circuit board. According to this aspect the antenna system formed on first and second dielectric layers. A ground plane conductive film is disposed between the dielectric layers. The first monopole antenna is formed on an outside surface of the first dielectric layer, and the second monopole antenna is formed on the outside surface of the second dielectric layer. (Both antennae could be formed on same surface.) The second monopole antenna is arranged generally orthogonally to the first monopole antenna. The feed circuit is coupled to the first and second monopole antennas to connect them to electronics on the printed circuit board. The first and second monopole antennas comprise impedance matched microstrips, and the feed circuit comprises a first impedance matched unbalanced line coupled to the first monopole antenna, and a second impedance matched unbalanced line coupled to the second monopole antenna.

According to another aspect of the invention, the ground plane conductive film includes a first member having an edge near the first and second monopole antennas, the edge including a first section generally orthogonal to one end of the first monopole antenna, and a second section generally orthogonal to one end of the second monopole antenna. A second member of the ground plane conductive film may be coupled to the first member and extend generally between the two antennas to improve isolation.

Tuning stubs may be used in association with the ground plane conductive film and with the first and second monopole antennas.

The first and second monopole antennas comprise essentially straight microstrips having a length of about one quarter wavelength at a nominal center frequency for the antenna system. Alternatively, the microstrips may be essentially straight for a majority of their length, and have an elbow to accommodate a narrow form factor, such as a PCMCIA form factor for a printed circuit board. The elbow has negligible impact on antenna-antenna isolation.

The present invention can also be characterized as an antenna system for communications device, which includes a circuit board with circuitry providing communications functions and a shield coupled to the circuit board and shielding the circuitry. The antenna system comprises a first dielectric layer coupled to the circuit board and extending outside the shield, having an outside surface and an inside surface. Also, a second dielectric layer is coupled to the circuit board and extends outside the shield, having an outside surface and an inside surface. A ground plane conductive film is coupled to the circuitry and extends outside the shield between the inside surfaces of the first and second dielectric layers. A first monopole antenna extends outside the shield, and comprises an impedance matched microstrip on the outside surface of the first dielectric layer. A second monopole antenna extends outside the shield and comprises an impedance matched microstrip on the outside surface of the second dielectric layer, and is arranged generally orthogonally to the first monopole antenna. A feed circuit including a first impedance matched unbalanced line coupled to the first monopole antenna and a second impedance matched unbalanced line coupled to the second monopole antenna, connects the first and second monopole antennas to the circuitry of the communications device on the circuit board.

A switch is coupled to the feed circuit to selectively connect the first and second monopole antennas to the circuitry to combat the effects of multipath interference.

Thus, a pair of electrically isolated monopoles can be fabricated on a multilayer printed circuit board. The board consists of two layers of dielectric with metalization on top, and between the two dielectric layers. The middle metal layer forms a ground plane. The monopole antennas are printed on the top and bottom layers of the board, at right angles to each other. The orthogonal arrangement creates field patterns which are orthogonal to each other. Thus, each antenna is oriented in such a way that there is minimal coupling between the elements. This results in a high degree of isolation.

The antennas can be adapted to fit into small form factor printed circuit boards. Thus, the ends of each monopole antenna can be slightly bent to conform to the edge of the board. Tuning stubs can be added to optimize antenna characteristics. In addition, a ground trace can be inserted between the two elements to further increase isolation between them.

Other aspects and advantages of the present invention can be seen upon review of the figures, the detailed description, and the claims which follow.

DETAILED DESCRIPTION OF PREFERRED EMBODIMENTS

Figure 1:
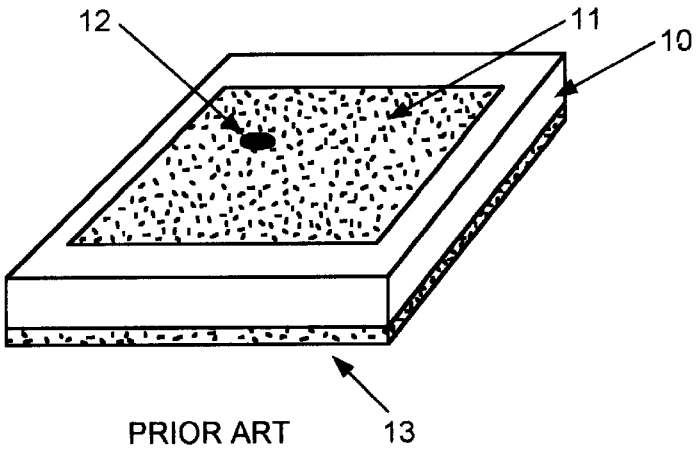
PRIOR ART FIG. 1
FIG. 1 illustrates a prior art ceramic patch antenna.
Figure 2:
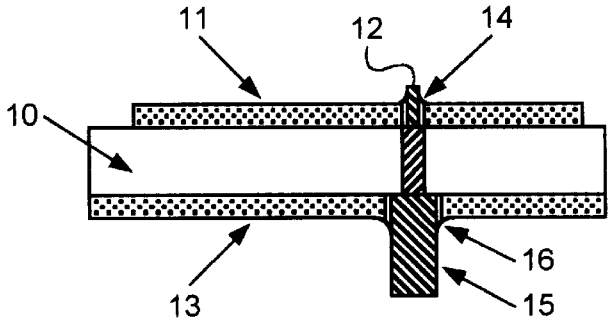
PRIOR ART FIG. 2
FIG. 2 is a side view of the prior art ceramic patch antenna.
Figure 3:
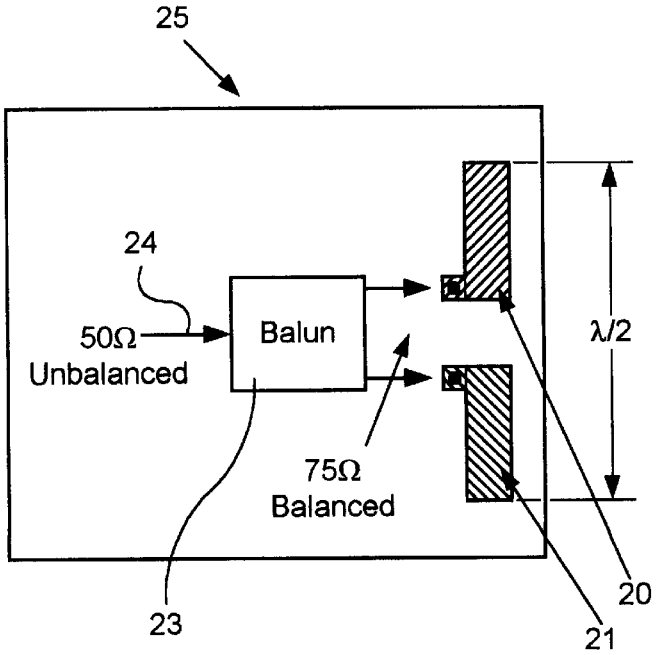
PRIOR ART FIG. 3
FIG. 3 is an illustration of a prior art dipole antenna arrangement.
Figure 4:
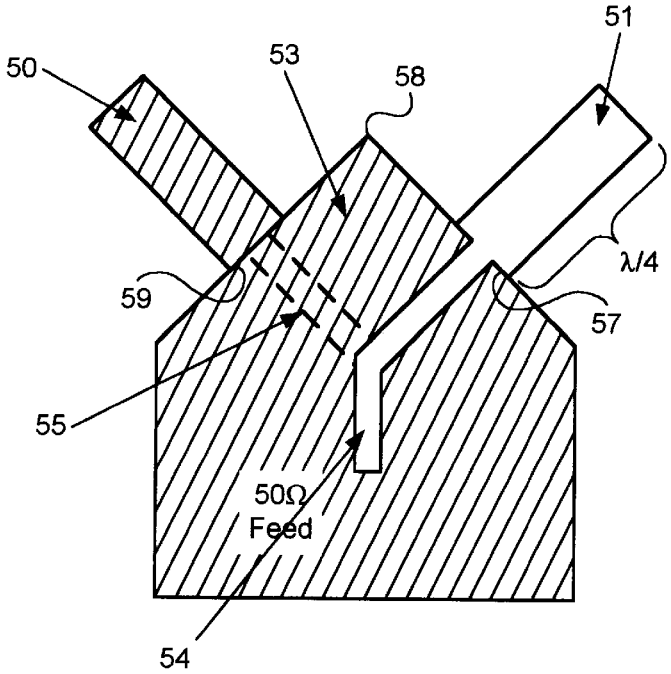
FIG. 4 is a top view of the antenna arrangement according to the present invention.
Figure 5:
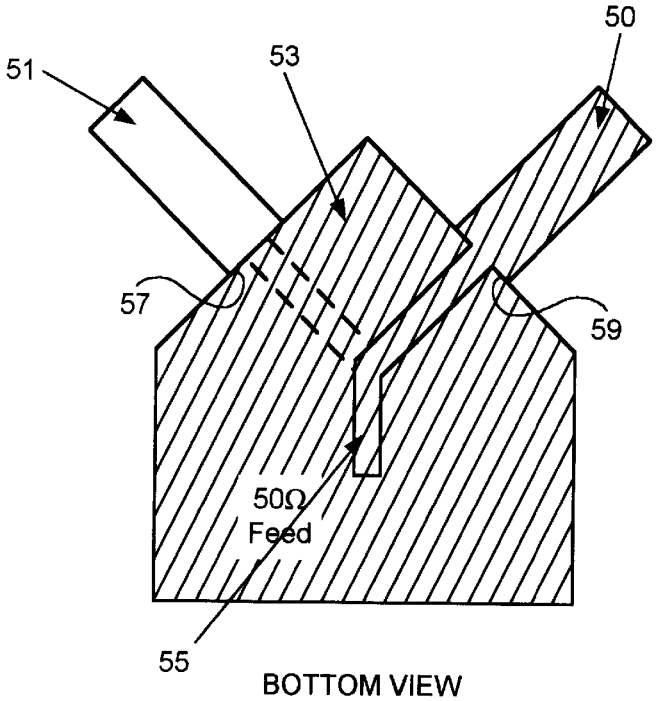
FIG. 5 is a bottom view of the antenna arrangement of FIG. 4.

A detailed description of preferred embodiments of the present invention is provided with reference to FIGS. 4–17, in which FIGS. 4 and 5 illustrate the basic concept.

FIG. 4 shows the top view of a pair of orthogonal monopole antennas fabricated on a low cost printed circuit board according to the present invention. The dielectric layers are not shown for clarity. Rather, the three metalization layers are illustrated, including the first element 50 on the bottom surface of the device, the second element 51 on the top surface of the board, and the ground plane 53 disposed generally between the feed element 55 for the first element 50 and the feed element 54 for the second element 51. A first dielectric layer, not shown, is between the first element 50 and the ground plane 53, and a second dielectric, not shown, is between the second element 51 and the ground plane 53 A 50 ohm feed 54 is coupled to the second element 51 as shown in the figure. Similarly, a 50 ohm feed 55 represented by the dashed lines, is coupled to the first element 50 on the bottom side.

FIG. 5 shows a bottom view of the device, of FIG. 4. Thus, the first element 50 is found on the right side of the figure. The 50 ohm feed 55 overlays the ground plane 53. The second element 51 is found on the right side. Again, the dielectric layers are not shown in FIG. 5.

With reference to FIG. 4, certain characteristics of the antenna system are illustrated. In particular, the monopole antennas, such as the second element 51, comprise microstrips formed on the dielectric layer, which extend about $\lambda/4$ beyond region generally 57 on the edge 58 of the ground plane 53, whereon $\lambda$ is the wavelength of the nominal center frequency for the communications device using the antenna. Beginning at the edge 58 in the region 57, a 50 ohm feed which comprises an unbalanced microstrip extends from the antenna element 51, for connection to circuitry on the printed circuit board.

Thus, as shown in FIG. 4, the ground plane includes a triangular end region defined by the edge, generally 58. This triangular end region defined by the edge 58 includes a section 57 which is generally perpendicular to the second element 51 and a section 59 which is generally perpendicular to the first element 50.

The impedance of the microstrip antenna elements 50 and 51, and the microstrip feed elements 54 and 55, is defined by the thickness of the dielectric, its dielectric constant, and the width of the line which defines the microstrip. This provides for matched impedance elements adapted for connection to standard transmission lines without matching circuits. Thus, in a preferred system, the feed elements comprise 50 ohm matched feed lines, and the microstrip antennas are matched impedance microstrips for connection to the 50 ohm lines. This eliminates the need for matching networks on the printed circuit board.

As mentioned above, the ground plane 53 includes a generally triangular end section defined by the edge 58 and the regions 57 and 59. This shape is not necessarily triangular, however it is preferable that the regions 57 and 59 be generally orthogonal to one end of the respective antenna elements 50 and 51.

Thus, perpendicular antennas isolated from one another by a combination of features is provided. The isolation is provided by using matched impedance feed lines, using the three layer circuit board structure and by the ground plane disposed generally between the antennas. Also, the isolation is enhanced by the orthogonal arrangement of the antennas.

Figure 6:
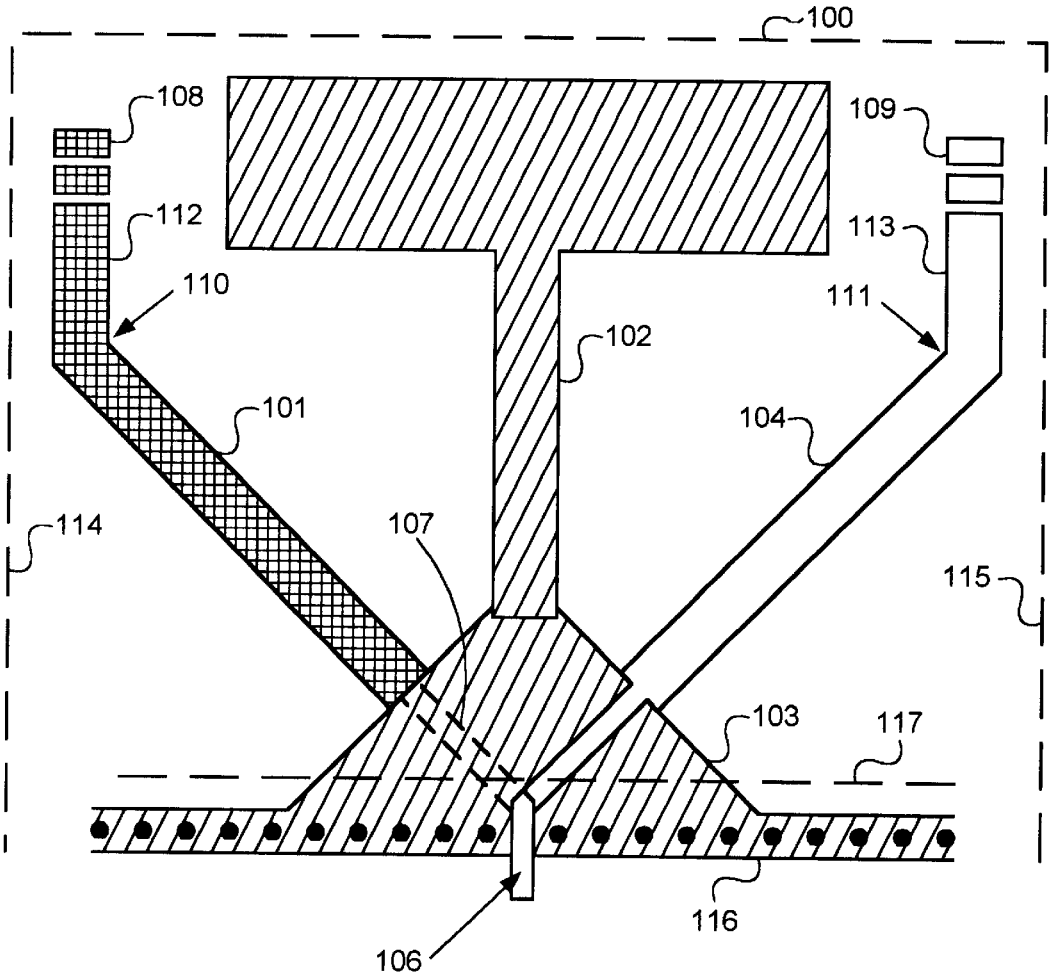
FIG. 6 is an expanded view of a preferred embodiment of the antenna system of the present invention.

FIG. 6 illustrates an expanded view of a preferred embodiment of the present invention which has been designed to fit within the PCMCIA form factor for printed circuit boards. Thus, the edge of the printed circuit board is generally represented by the line 100. A first monopole element 101 is formed on the outside surface of a bottom layer of dielectric. A ground trace 102 is formed between the layers of the dielectric. Alternatively, the ground trace 102 could be placed on one or both of the outside surfaces of the dielectric and connected by vias to the ground plane. The ground plane 103 is formed in between the top and bottom layers of dielectric as described above with respect to FIGS. 4 and 5. A second monopole element 104 is formed on the outside surface of the top layer of the dielectric. A similar ground trace, not shown, is formed on the outside surface of the bottom layer of dielectric.

As described with reference to FIGS. 4 and 5, the monopole element 104 is coupled to an unbalanced impedance matched feed line 106 which comprises a microstrip formed on the outside surface of the top layer of dielectric. A similar feed line generally 107 is formed connecting the element 101 to the circuitry, and formed on the outside surface of the bottom dielectric layer. Tuning stubs generally 108 and 109 are formed adjacent to the ends of the monopole elements 101 and 104, respectively. Furthermore, the monopole elements 101 and 104 are generally straight microstrips along the majority of their length, but have an elbow, 110, 111 near the end of the element to accommodate the form factor of the circuit board 100. Thus, a tip segment of the microstrip antenna, generally 112 for element 101, and 113 for element 104, stand parallel to the sides, generally 114 and 115 of the printed circuit board 100. Because of the elbow structure, isolation of the antennas, due to the orthogonal relationship, is reduced. Thus, the ground trace 102 is added to improve that isolation.

The ground plane 103 is coupled to the circuitry on the circuit board 100, by means of vias, generally 116. Also, a shield structure, not shown in FIG. 6, extends to a shield line 117. The shield comprises a conductive material which is coupled to the ground plane by means of the vias 116, shielding the circuitry on the circuit board 100 from the antenna structure.

Figure 7:
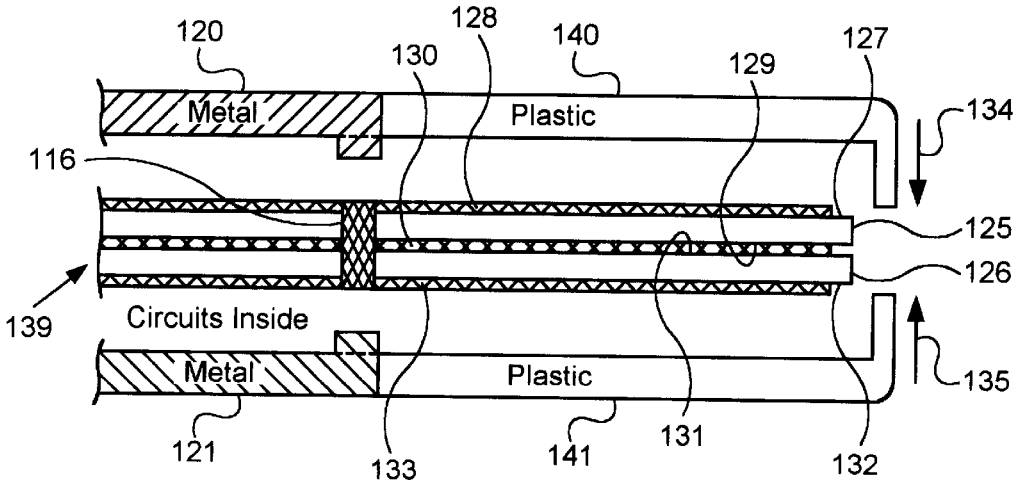
FIG. 7 illustrates the circuit board shielding structure according to the present invention.
Figure 8:
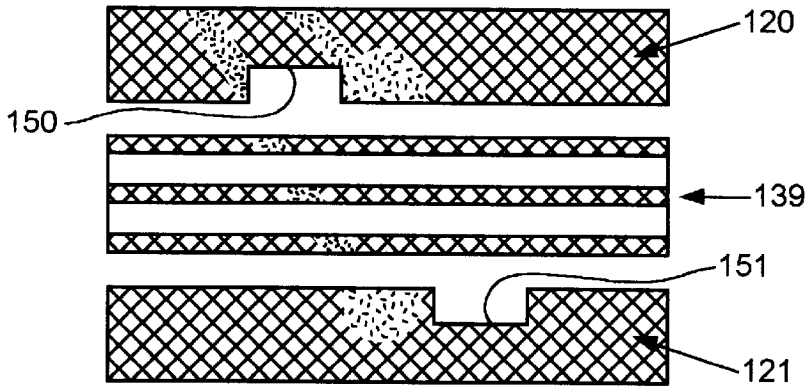
FIG. 8 is an end view of the circuit board structure of FIG. 7.

FIG. 7 illustrates a side view of the communications device assembly which includes the antenna structure of the present invention. As shown in FIG. 7, a shield metal covering 120 is provided for a top side of the device, and a metal covering 121 is provided for the bottom side. Circuitry is mounted on the circuit board inside the shield structure. The ground vias 116 contact the shields 120 and 121 when the structure is assembled. The antenna system includes a first dielectric layer 125 and a second dielectric layer 126 which are coupled to the circuit board inside the shield, and extend beyond the shield. On the outside surface, generally 127, of the first layer 125 of dielectric, metalization 128 is provided to establish the ground trace 102 and the antenna element 104 of FIG. 6. The inside surface 129 of the first dielectric layer is coupled to the ground plane metalization 130. Similarly, the inside surface 131 of the bottom layer 126 of dielectric is coupled to the ground plane 130. The outside surface 132 of the bottom layer of dielectric 126 carries metalization 133 for the antenna element 101 and a ground trace, not shown, in FIG. 6.

As represented by the arrows, generally 134 and 135, the shield structure including metal 120 and plastic extension 140, and metal 121 and plastic extension 141 are snapped over the circuit board assembly and antenna system to enclosed the device. The plastic will be transparent to the RF wavelengths used by the communications device.

FIG. 7 shows the tip of a printed circuit board, generally 139, which includes the antenna system of the present invention. An end view of the assembly of FIG. 7 is provided in FIG. 8. As can be seen, the shield member 120 and 121 are designed to connect with the three layer circuit board structure 139 at the positions of the vias 116, shown in FIGS. 6 and 7. In one embodiment, layers 2–5 of a 6-layer printed circuit board PCB are fused to create, ineffect, 3 layers. Cut out regions 150 for the top layer and 151 for the bottom layer on the shield structure 120 and 121 provide for passage of the unbalanced feed lines 106 and 107 inside the shield from the antenna structure outside. Alternatively, a buried signal line can be used as described below with respect to FIGS. 18 through 20.

Figure 9:
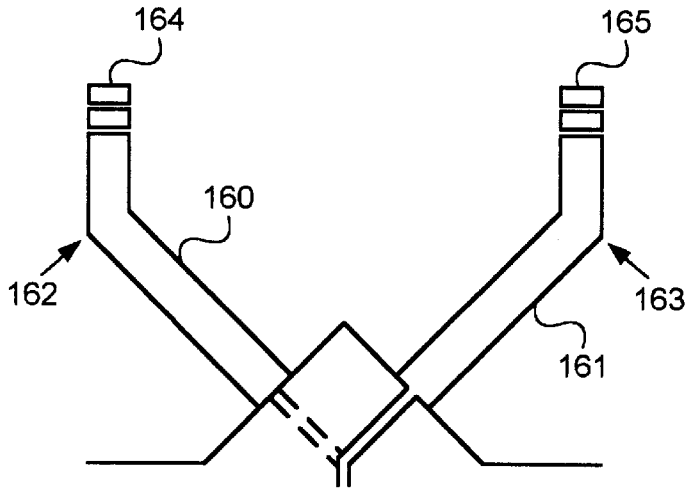
FIG. 9 illustrates an alternative embodiment of the dual monopole antenna system of the present invention.
Figure 10:
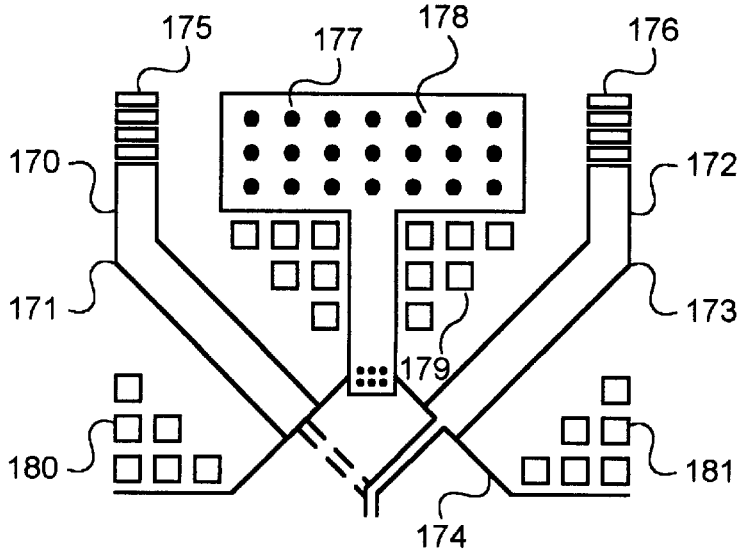
FIG. 10 illustrates yet another alternative embodiment of the dual monopole antenna system of the present invention.

FIGS. 9 and 10 illustrate variations in the layout of the dual monopole antenna system of the present invention to illustrate certain optional features. In particular, FIG. 9 illustrates a layout which includes monopole elements 160 and 161 arranged generally orthogonally to one another. These monopole elements include the elbows, generally 162 and 163, and tuning stubs, generally 164 and 165, shown in FIG. 6. However, no ground trace 102 is utilized in this embodiment.

FIG. 10 illustrates yet an alternative approach. In this system, a first monopole antenna 170 including an elbow 171 is provided. A second monopole antenna 172 including elbow 173 is arranged generally orthogonally to the first monopole antenna 170. A ground plane 174 having the characteristics described above with reference to FIGS. 4 and 5 is included. In the embodiment shown in FIG. 10, there are a larger number of tuning stubs, generally 175 and 176 used near the ends of the monopole elements 170 and 172, such that the effective length of the monopole elements can be tuned as needed.

Also, a ground trace 177 is included on the outside surfaces of the dielectric layers. In this embodiment vias, generally 178, are included in the ground traces which couple the ground traces on the top and bottom together. Furthermore, a plurality of tuning stubs 179 is used in association with the ground traces 177 for optimizing performance of the system. Similarly, tuning stubs 180 and tuning stubs 181 for use in connection with the ground plane 174 are added.

Figure 11:
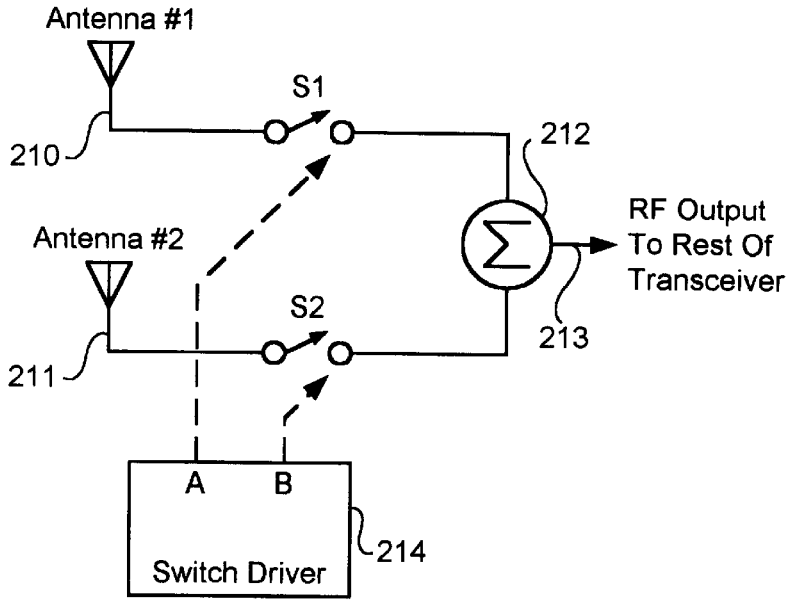
FIG. 11 illustrates the control circuitry for managing antenna diversity according to the present invention.

FIGS. 11–17 illustrate the circuitry used for selecting an active one or a combination of active antennas for the communications device. Thus, in FIG. 11 a conceptual schematic diagram of one approach to selecting an active antenna is illustrated. As shown in FIG. 11, a first antenna 210 and a second antenna 211 are provided. Each antenna is coupled to a switch S1 and S2, respectively. The switches are coupled to a summing junction 212. The output of the summing junction is provided on line 213 to the rest of the communications device or transceiver. A switch driver 214 controls the switches S1 and S2, so that the active antenna can be changed to take optimum advantage of spatial diversity for the device. In a preferred system, for high traffic networks, an intelligent switch driver actively determines the antenna receiving the best signal, and selects that antenna as the active device. The intelligent switch driver may comprise software in the processor driving the transceiver which uses the antennas that executes an algorithm to improve antenna performance using so-called selection diversity. According to selection diversity, the dynamic algorithm determines which antenna is receiving the signal best, and controls the switch to optimize the use of the antenna diversity.

Figure 12:
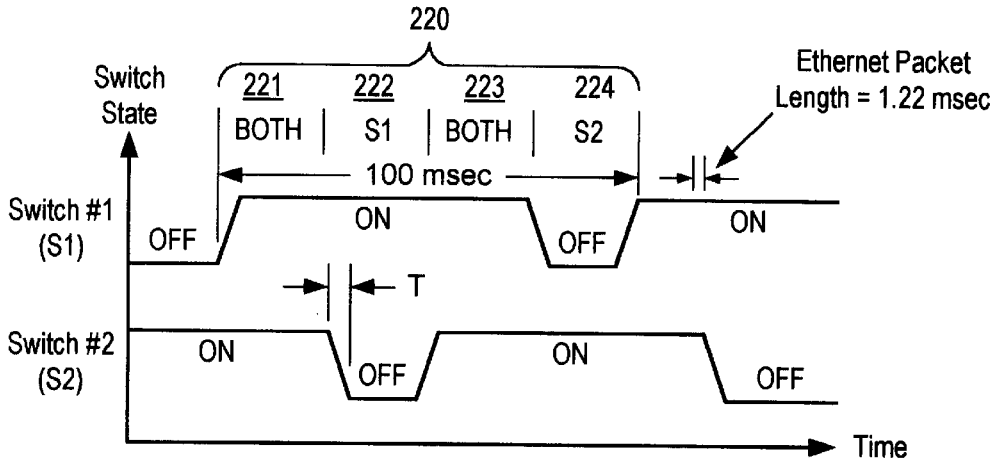
FIG. 12 is a timing waveform for one control sequence for the dual antenna system according to the present invention.

In an alternative embodiment the switch driver 212 automatically switches between antennas independent of other processing. This automatic dithering between antennas is suitable for low-cost, low traffic uses. The timing wave forms, according to this low frequency dithering aspect of the present invention, can take the shapes shown in FIGS. 12 and 13. In FIG. 12, a four state antenna system is provided. The oscillating driver 214 periodically switches the antenna system through the four states automatically. Thus, one period for the oscillating switch driver 214, as shown in FIG. 12, is a 100 millisecond cycle, generally 220. In the cycle 220, there is a first state, generally 221, in which both switches are on, a second state, generally 222, during which switch S1 is on and switch S2 is off, a third state, generally 223, during which both switches are on, and a fourth state, generally 224, during which switch S2 is on and switch S1 is off. This cycle 220 continuously and automatically repeats to ensure spatial diversity in the receiving system.

Also, as shown in FIG. 12, it can be seen that the transitions, such as transition T, are relatively gradual, so that the switches turn off slowly. The transition time T is substantially greater than the characteristic packet reception time of the system. Thus, for a wireless system which communicates Ethernet packets, the maximum packet length is about 1.22 milliseconds. Thus, the transition time T for such a system would range from 2 to 10 milliseconds. The gradual transition T allows for a "fade" effect as the state changes, so that packets being transmitted or received during the change are less likely to be lost.

The cycle time 220 is on the order of 100 milliseconds or less, so that within the human reaction time, the best state of the antenna system will be provided for communicating a given packet. Thus, if the packet transmitted during a state during which poor reception occurs, it will be retried during a following state, within a period of time which is not noticeable by human operators.

Furthermore, each of the states is substantially longer than the maximum packet length in the communication system. This ensures that during any given state, a number of packets can be transmitted successfully before a less desirable antenna configuration is switched to. Thus, the period of oscillating switch driver is substantially greater than the maximum packet length, preferably each state during the period 220 is greater than 10 times the maximum packet length.

The four state cycle 220 offers in effect three antenna configurations to combat multipath effects with spatial diversity. During the state in which both switches are on, a "array antenna" is set up which has spatial characteristics which appear offset to region between the two antennas.

Figure 13:
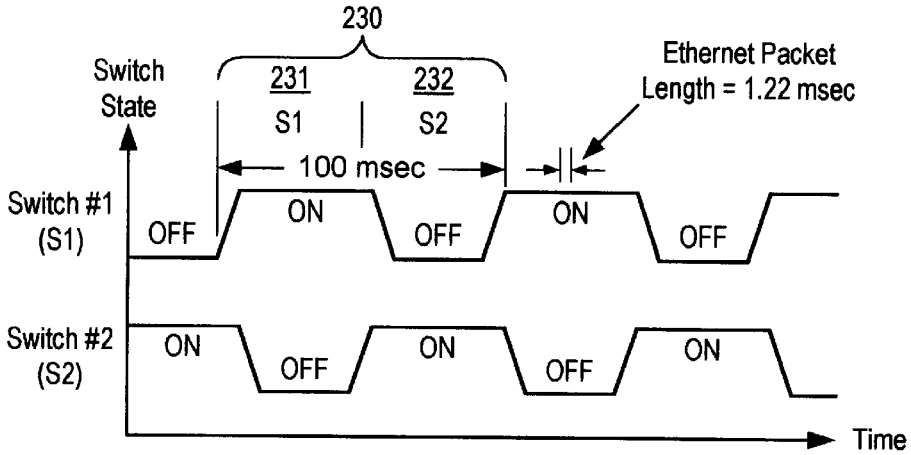
FIG. 13 is a timing waveform for an alternative control sequence for the dual antenna system of the present invention.

An alternative antenna dithering control waveform is shown in FIG. 13, in which each cycle, generally 230, has two states, state 231, during which switch S1 is on, and state 232, during which S2 is on. Again, the cycle time is on the order of 100 milliseconds or less.

One key to the operation is that the packet length is much shorter than the dwell time on each antenna position. For example, if the period of the digital oscillator is equal to 100 milliseconds and the packet length is only 1.2 milliseconds, as in the case of Ethernet, many packets can be transmitted during each antenna configuration state. If both states are such that neither antenna is in a multipath null, then no packets are dropped. If one antenna position is in a null, then the probability of the other position being in a null is vanishingly small. The period of less than about 100 milliseconds. If one position is in a null, there will be an interruption in the link, but the user will not perceive the delay due to the fact that one tenth of a second is very short in terms of human reaction times. In addition, the switching on and off is done relatively gradually. This is done so that the receiver sees no switching impulses, and so that the antenna environment changes gradually with respect to packet length.

Figure 14:
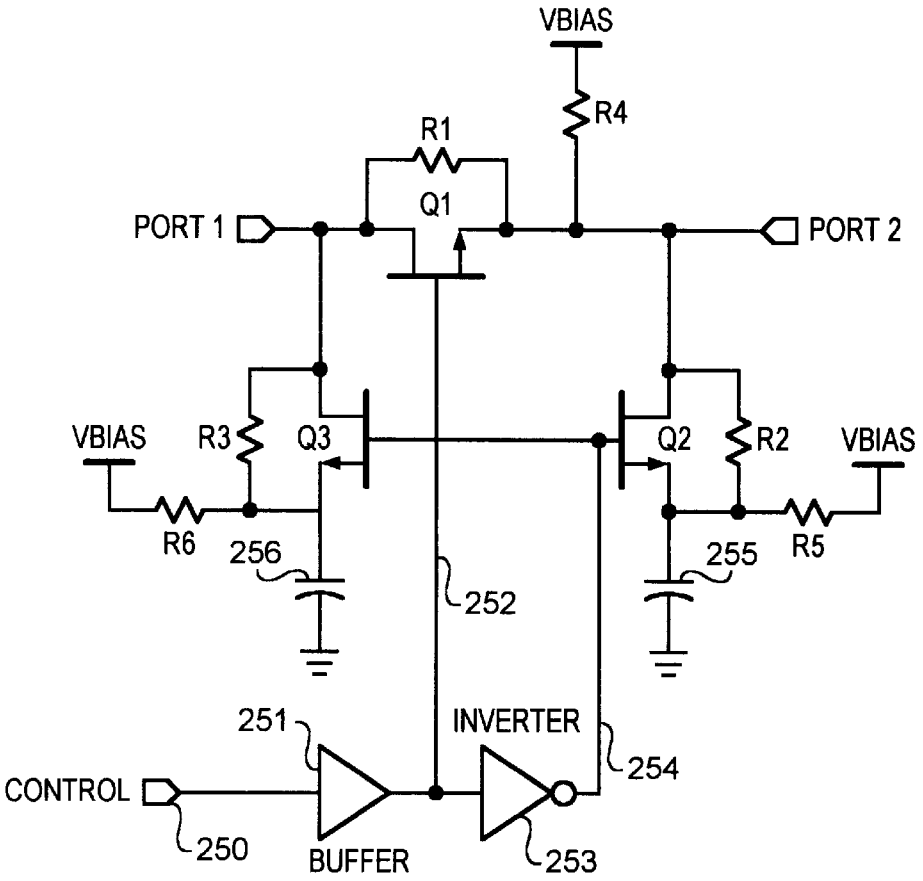
FIG. 14 is a schematic diagram of a switch which can be used in the system of FIG. 11.

FIG. 14 illustrates a monolithic microwave integrated circuit design, which could be used for the switches S1 and S2 in an integrated circuit embodiment of the present invention. In FIG. 14, the switch is based on three MESFET transistors, Q1, Q2, and Q3. The oscillating switch driver supplies a control signal on line 250, having a shape, such as illustrated for switch S1 or switch S2 in FIG. 12 or FIG. 13. The control signal is supplied through buffer 251 to the gate of transistor Q1 across line 252. Also, the output of the buffer 251 is connected to an inverter 253. The output of the inverter 253 is connected across line 254 to the gates of transistors Q2 and Q3. The drain of transistor Q1 is connected to PORT1 which would be connected to the feed for an antenna, such as antenna 210 of FIG. 11. The source of transistor Q1 is connected to PORT2, which is connected to the summing junction 212 of the circuit of FIG. 11.

The drain of transistor Q2 is connected to PORT2, and the emitter of transistor Q2 is connected through a capacitor 255 to ground. Similarly, the drain of transistor Q3 is connected to PORT1, and the emitter of transistor Q3 is connected to a capacitor 256 to ground.

Each of the transistors Q1, Q2, and Q3 has a resistor, R1, R2, R3 connected across its source and drain, and a resistor R4, R5, R6 connected from the source to a bias potential VBIAS. The voltage VBIAS is essentially one diode drop below the power supply level $V_{DD}$ for the circuit.

Figure 15:
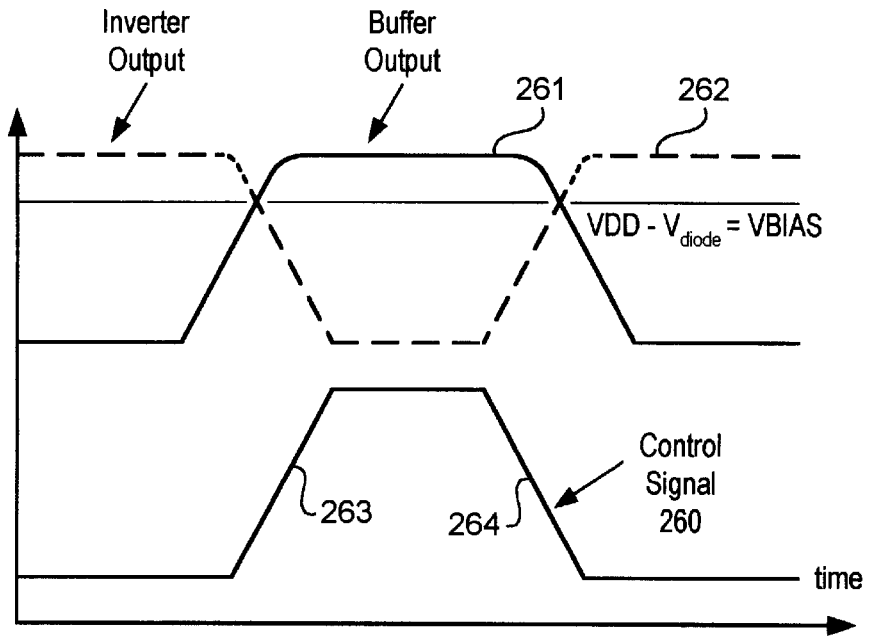
FIG. 15 is a timing waveform illustrating operation of the switch of FIG. 11.

FIG. 15 is a timing diagram for operation of the switch of FIG. 14. The control signal is shown at trace 260, the output of the buffer 251 is shown at trace 261, and the output of the inverter 253 is shown at trace 262. In operation, the switch provides a gradual switching from a first open state to a closed state, determined by the slope of the transition, generally 263, on the control signal 260. Thus, when the control signal begins to rise in the region 263, transistor Q1 slowly turns on, directly connecting PORT1 to PORT2. Similarly, transistors Q3 and Q4 slowly turn off in response to the output of the inverter, disconnecting PORT1 and PORT2 from ground. During the transition 264 of the control signal 260, the transistor Q1 turns off as the control signal drops, while transistors Q3 and Q2 turn on.

Figure 16:
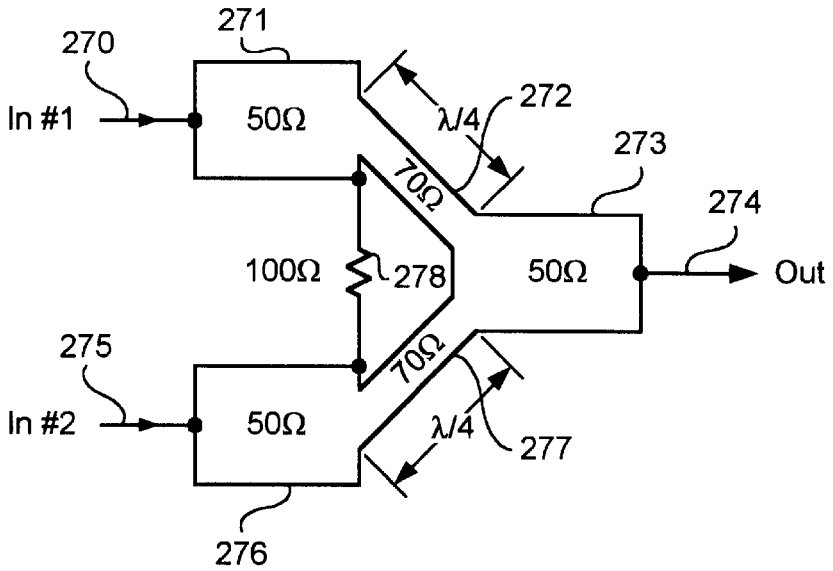
FIG. 16 illustrates a Wilkinson coupler which can be used for the summing junction for the system of FIG. 11.

FIG. 16 illustrates a preferred embodiment of the summing junction 212 of FIG. 11. In the embodiment of FIG. 16, a Wilkinson coupler is utilized to connect the outputs of the switches to a single ended unbalanced line to the circuitry of the communications device. Thus, the output of switch S1 is supplied on line 270 to a 50 ohm microstrip 271. The 50 ohm microstrip 271 is coupled to a 70 ohm microstrip 272 which is about $\lambda/4$ long, where $\lambda$ is the wavelength of the nominal center frequency of the communications device. The 70 ohm microstrip 272 is coupled to a 50 ohm microstrip 273 which provides the output on line 274. Similarly, the input from the second switch is provided on line 275 to a 50 ohm microstrip 276. The 50 ohm microstrip 276 is connected to a 70 ohm microstrip 277 which is about $\lambda/4$ long, which is in turn coupled to the rnicrostrip 273. A resistor 278 is coupled between the ends of the microstrips 271 and 276 adjacent the connections to the 70 ohm microstrips 272 and 277. This is a 100 ohm resistor in the embodiment illustrated, used for isolation of the two inputs.

Figure 17:
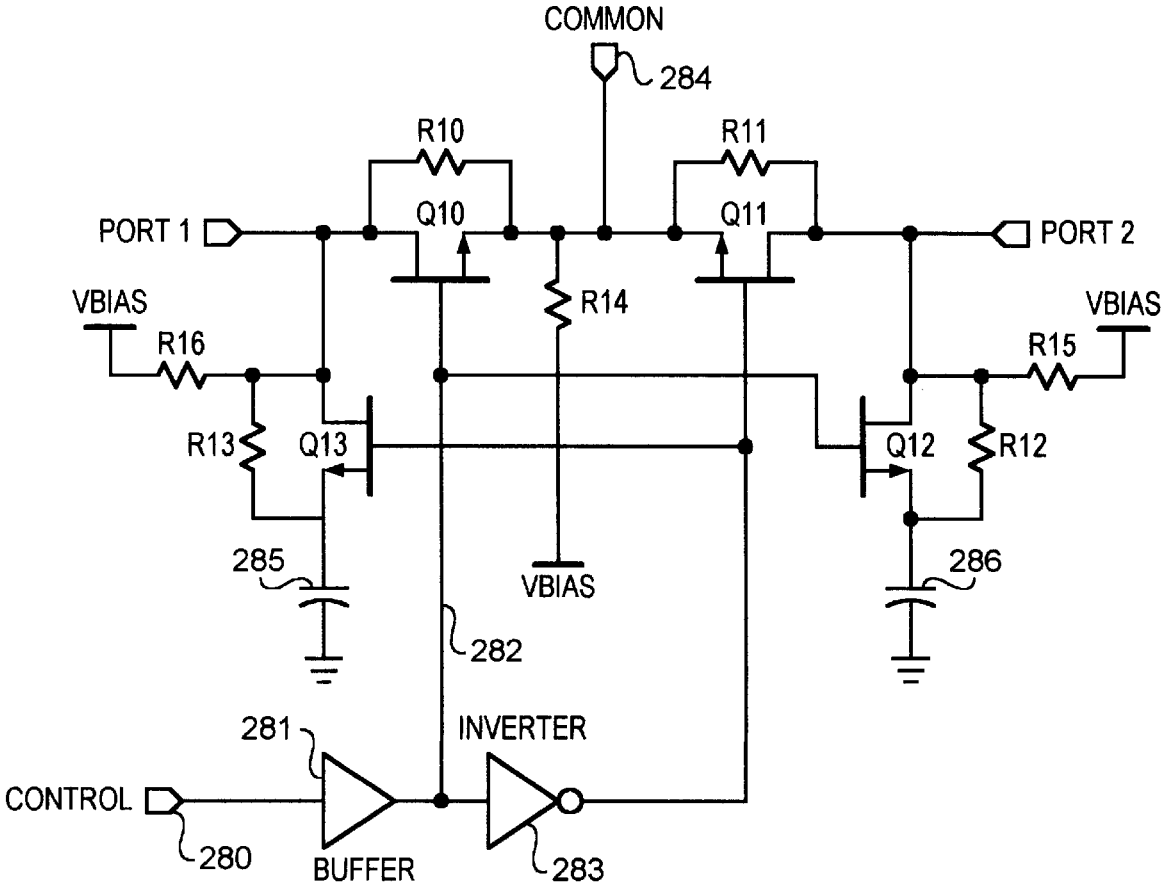
FIG. 17 is a schematic diagram of an alternative switching system for use with the antennas of the present invention.

An alternative system can be implemented using a monolithic microwave integrated circuit switch as shown in FIG. 17. This switch is useful, for instance, when the antennas are controlled so that one is on or the other is selected, and never both at the same time. Furthermore, this switch would be useful if the switching between antennas is controlled by the host processor in response to the quality of the signals received on the antennas, rather than automatically as described above with reference to FIGS. 12–13.

Thus, FIG. 17 is a switch based on four MESFET transistors Q10, Q11, Q12, and Q13. The antennas are connected to PORT1 and PORT2, respectively. The output of the switching circuit is applied to the common node 284. A control signal is received on line 280 and supplied to buffer 281. The output of the buffer is applied on line 282 to the gates of transistors Q10 and Q12. Also, the output of the buffer is applied to inverter 283. The output of the inverter 283 is applied to the gates of transistors Q11 and Q13. Transistor Q10 has its drain connected to PORT1, and its source connected to the common node 284. Transistor Q11 has its drain connected to PORT2 and its source connected to the common node 284. Transistor Q13 has its drain connected to PORT1 and its source connected through capacitor 285 to ground. Transistor Q12 has its drain connected to PORT2 and its source connected across capacitor 286 to around. Each ofthe transistors Q10–Q13 has a resistor R10, R11, R12, and R13 connected across its drain and source. Also, the common node 284 is connected across resistor R14 to the potential VBIAS which is about one diode drop below the supply voltage $V_{DD}$. The drains of transistors Q12 and Q13 are coupled across transistors R15 and R16, respectively to the bias potential VBIAS. In operation, when the control signal on line 280 is high, transistors Q10 and Q12 are on. This connects PORT1 to the common node 280, and pulls PORT2 to AC ground. When the control signal on line 280 is low, transistors Q11 and Q13 are on, connecting PORT2 to the common node 284, and pulling PORT1 to AC ground. The common node 284 is connected to the circuitry of the communication device directly, so no summing junction, such as that illustrated in FIG. 16, is required.

Thus, as shown in FIG. 11, the two antennas of the system are connected to a summing junction through a pair of switches. The switches can be intelligently controlled or controlled by a free running, oscillating digital logic circuit which produces the waveform shown in FIGS. 12 or 13.

Figure 18:
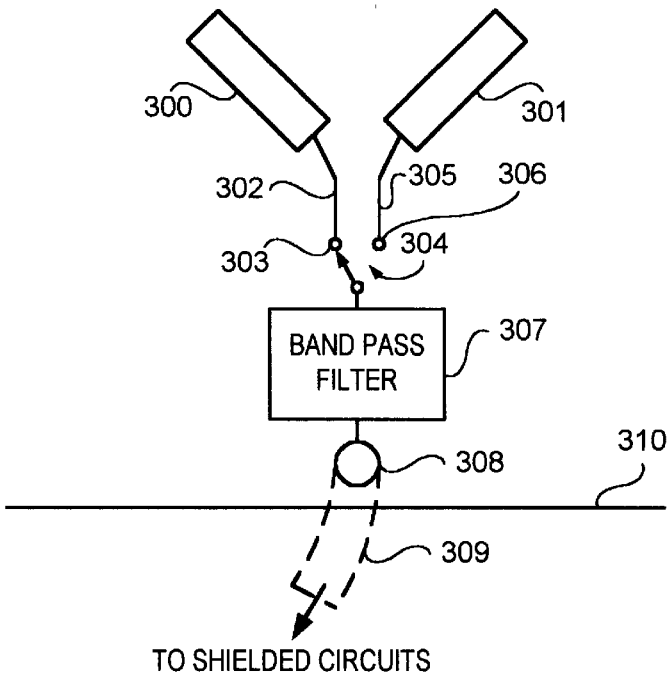
FIG. 18 is a simplified block diagram of an alternative switch arrangement for use on a printed circuit board according to the present invention.
Figure 19:
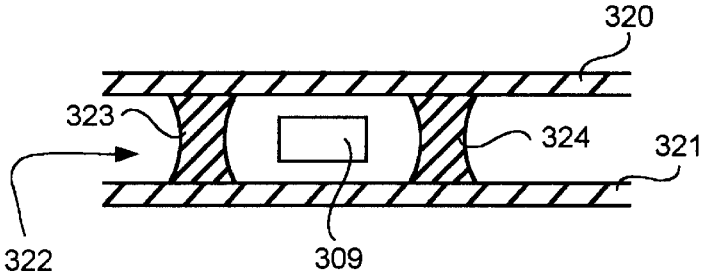
FIG. 19 illustrates the positioning of the signal line inside the printed circuit board in the system of FIG. 18.
Figure 20:
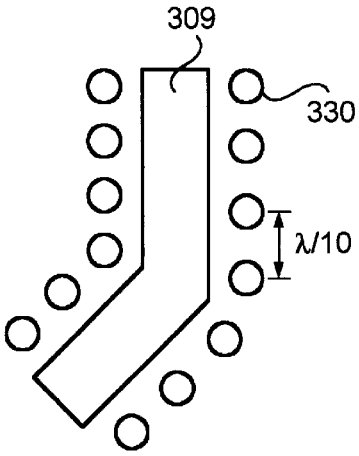
FIG. 20 shows a top view of the layout of the signal line used in the system of FIG. 18.

FIGS. 18 through 20 show an alternative embodiment for positioning the dual orthogonal antennas outside of the shield structure in a printed circuit board embodiment like that shown in FIG. 7. According to the embodiment shown in FIG. 18, a signal line 309 is buried between the layers of dielectric (125 and 126 of FIG. 7) and connected to the circuits inside the shield structure. Therefore, no notches (150–151 in FIG. 8) are necessary in the shield structure.

Thus, in FIG. 18 first and second orthogonal microstrip antennas 300 and 301 are formed on the outside surfaces of the dielectric as discussed above. The ground plane and other structures for the orthogonal monopoles are not shown in FIG. 18 for simplicity. However the antennas are intended to have the structure discussed above, for instance with reference to FIG. 6.

In FIG. 18, the first antenna 300 has feed line 302 which is connected to a first pole 303 of switch 304. The second antenna 301 has a feed line 305 connected to the second pole 306 of the switch 304. The switch supplies the selected signal through a bandpass filter 307 to a signal line via 308 on the surface of the board. The signal line via 308 connects to the signal line represented by the dotted lines 309, which is formed in the metalization between the layers of dielectric. The shield barrier is illustrated by the line 310 in FIG. 18. Thus, the signal line 309 provides a means for providing a signal from node 308 into the circuitry within the shield.

The switch 304 can be implemented using a very small monolithic microwave integrated circuit (MMIC) with techniques known in the art. The filter 307 can also be a small surface mounted device. This structure can be mounted on the outside surface of one of the dielectric layers.

FIG. 19 shows the buried signal line 309 in the dielectric structure. Thus in FIG. 19, a top ground plane 320 and a bottom ground plane 321 are shown. The dielectric layers are formed generally in the region 322. Vias 323 and 324 are formed along the sides of the signal line 309. The height and width of the signal line 309 are adjusted to establish a 50 ohm strip line for a short run. Also, the strip line is centered within the structure to improve the impedance characteristics. The signal line 309 is laid out in top view as shown in FIG. 20. Thus the signal line 309 has vias generally 330 arrayed along the side of the signal line in a "picket fence" arrangement. The space in between the vias is about one tenth of the wavelength of the center frequency to shield the buried strip line.

Accordingly, a preferred system may provide for a buried signal line which reduces the manufacturing costs of the shielding structures for the system according to the present invention, with an antenna switch MMIC and bandpass filter placed outside the shield.

Accordingly, an improved antenna system for a communications device allows for low cost manufacture while maintaining spatial diversity on a small device, such as within the PCMCIA form factor. The antenna system is based on orthogonally disposed isolated monopoles fabricated on multilayer printed circuit board. Tests of the return loss of elements configured as shown in FIG. 6 illustrate a very good return loss and isolation between the antennas over frequency. The return loss has been measured at below 15 dB for an untuned trace, and below 27 dB for a tuned trace across the 2.4 to 2.485 GHz ISM band. This implies an excellent 50 ohm match with a very low loss feed. Furthermore, isolation is better than 15 dB for both the top and bottom traces, implying little interaction between each element. The bandwidth for both antennas is much wider than the ISM band itself Thus, normal manufacturing tolerances will have little effect on antenna performance.

Accordingly, an efficient antenna system which is physically small and can be fabricated on a low cost printed circuit board is provided. The bandwidth is wide enough to account for manufacturing tolerances without degrading performance. The system includes impedance matched elements, so that no matching circuits are required; and provides a 50 ohm unbalanced line feed for each antenna simplifying connection to the circuitry which relies on the antennas. Furthermore, each antenna is electrically isolated from the other, so that true spatial diversity can be achieved.

The foregoing description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

What is claimed is:

1. An antenna system, comprising:

a first monopole antenna, the first monopole antenna generally disposed on a first layer, the first layer extending from a portion of a printed circuit board, the printed circuit board having circuitry mounted thereon, the circuitry providing communications functions;

a second monopole antenna arranged generally orthogonally to the first monopole antenna, the second monopole antenna generally disposed on a second layer, the second layer extending from the portion of the circuit board;

a ground plane conductor disposed generally between the antennas; and a feed circuit coupled to the first and second monopole antennas to connect the first and second monopole antennas to a host system.

2. The antenna system of claim 1, wherein the first and second monopole antennas comprise impedance matched microstrips.

3. The antenna system of claim 2, wherein the feed circuit comprises a first impedance matched unbalanced line coupled to the first monopole antenna, and a second impedance matched unbalanced line coupled to the second monopole antenna.

4. The antenna system of claim 3, including a ground plane conductor extending generally between the first impedance matched unbalanced line and the second impedance matched unbalanced line.

5. The antenna system of claim 1, wherein the first and second monopole antennas comprise microstrips having a length of about one quarter wavelength of a nominal center frequency for the antenna system.

6. The antenna system of claim 1, wherein the portion of the circuit board includes a plurality of layers, and circuitry of the host system is coupled to a first layer from among the plurality of layers.

7. The antenna system of claim 1, wherein the circuit board comprises the portion, the first layer, and the second layer.

8. The antenna system of claim 1, wherein the feed circuit alternately selects the first monopole and second monopole antennas.

9. The antenna system of claim 1, wherein the feed circuit alternately selects the first and second monopole antennas and a combination of both.

10. The antenna system of claim 1, wherein the feed circuit separately connects the first and second monopole antennas to the host system.

11. The antenna system of claim 1, the printed circuit board and the antennas fitting within a PCMCIA form factor.

12. The antenna system of claim 1, the circuitry mounted on the printed circuit board comprising microwave communications circuitry.

13. An antenna system, comprising:

a first dielectric layer having an outside surface and an inside surface;

a second dielectric layer having an outside surface and an inside surface, the second dielectric layer generally parallel to the first dielectric layer;

a ground plane conductive film between the inside surfaces of the first and second dielectric layers;

a first monopole antenna on the outside surface of the first dielectric layer;

a second monopole antenna on the outside surface of the second dielectric layer, and arranged generally orthogonally to the first monopole antenna; and a feed circuit coupled to the first and second monopole antennas to connect the first and second monopole antennas to a host system.

14. The antenna system of claim 13, wherein the first and second monopole antennas comprise impedance matched microstrips.

15. The antenna system of claim 14, wherein the feed circuit comprises a first impedance matched unbalanced line coupled to the first monopole antenna, and a second impedance matched unbalanced line coupled to the second monopole antenna.

16. The antenna system of claim 13, wherein the first and second monopole antennas comprise 50 ohm impedance matched microstrips on the outside surfaces of the first and second dielectric layers respectively.

17. The antenna system of claim 16, wherein the feed circuit comprises a first 50 ohm impedance matched unbalanced line coupled to the first monopole antenna, and a second 50 ohm impedance matched unbalanced line coupled to the second monopole antenna.

18. The antenna system of claim 13, wherein the ground plane conductive film includes a first member having an edge near the first and second monopole antennas including a first section generally orthogonal to and adjacent one end of the first monopole antenna and a second section generally orthogonal to and adjacent one end of the second monopole antenna.

19. The antenna system of claim 18, including a second ground plane member coupled to the ground plane conductive film, and extending generally between the first and second monopole antennas.

20. The antenna system of claim 13, wherein the ground plane conductive film includes a plurality of tuning stubs.

21. The antenna system of claim 13, including a plurality of tuning stubs adjacent the first and second monopole antennas on the outside surfaces of the first and second dielectric layers, respectively.

22. The antenna system of claim 13, wherein the first and second monopole antennas comprise essentially straight microstrips having a length of about one quarter wavelength of a nominal center frequency for the antenna system.

23. The antenna system of claim 13, wherein the first and second monopole antennas comprise microstrips having a length of about one quarter wavelength of a nominal center frequency for the antenna system, essentially straight for a majority of the length, and having an elbow to accommodate a form factor.

24. An antenna system for a communications device, the communications device including a circuit board with circuitry providing communications functions and a shield, the shield being coupled to the circuit board and being positioned with respect to the circuit board to shield the circuitry on the circuit board with respect to electromagnetic radiation, comprising:

a first dielectric layer coupled to the circuit board and extending outside the shield, the first dielectric layer having an outside surface and an inside surface;

a second dielectric layer coupled to the circuit board and extending outside the shield, the second dielectric layer having an outside surface and an inside surface;

a ground plane conductive film coupled to the circuitry and extending outside the shield between the inside surfaces of the first and second dielectric layers;

a first monopole antenna extending outside the shield, the first monopole antenna comprising an impedance matched microstrip on the outside surface of the first dielectric layer;

a second monopole antenna extending outside the shield, the second monopole antenna comprising an impedance matched microstrip on the outside surface of the second dielectric layer, and arranged generally orthogonally to the first monopole antenna; and a feed circuit to connect the first and second monopole antennas to the shielded circuitry.

25. The antenna system of claim 24, wherein the ground plane conductive film includes a first member having an edge near the first and second monopole antennas including a first section generally orthogonal to and adjacent one end of the first monopole antenna and a second section generally orthogonal to and adjacent one end of the second monopole antenna.

26. The antenna system of claim 25, including a second ground plane member coupled to the ground plane conductive film and extending generally between the first and second monopole antennas.

27. The antenna system of claim 24, wherein the ground plane conductive film includes a plurality of tuning stubs.

28. The antenna system of claim 24, including a plurality of tuning stubs adjacent the first and second monopole antennas on the outside surfaces of the first and second dielectric layers, respectively.

29. The antenna system of claim 24, wherein the first and second monopole antennas comprise essentially straight microstrips having a length of about one quarter wavelength of a nominal center frequency for the antenna system.

30. The antenna system of claim 24, wherein the feed circuit includes a switch to selectively connect the first and second monopole antennas to the circuitry.

31. The antenna system of claim 30, including an oscillating switch driver coupled to the switch.

32. The antenna system of claim 30, including resources to control the switch according to signal quality on the first and second monopole antennas.

33. The antenna system of claim 30, wherein the switch is mounted outside the shield, and the feed circuit includes a buried signal line.

34. The antenna system of claim 24, wherein the feed circuit includes a first impedance matched unbalanced line coupled to the first monopole antenna and a second impedance matched unbalanced line coupled to the second monopole antenna.

35. An antenna system for a communication device, comprising:

a first dielectric layer having an outside surface and an inside surface;

a second dielectric layer having an outside surface and an inside surface, the second dielectric layer generally parallel to the first dielectric layer;

a ground plane conductive film between the inside surfaces of the first and second dielectric layers;

a first monopole antenna on the outside surface of the first dielectric layer;

a second monopole antenna on the outside surface of the second dielectric layer, the second monopole antenna arranged generally orthogonally to the first monopole antenna;

a feed circuit coupled to the first and second monopole antennas; and a switch circuit and a switch driver, coupled to the feed circuit, which periodically selects the first monopole antenna and the second monopole antenna with a period greater than a characteristic reception interval for packets of data received at the antenna system, independent of other processing in the communications device.

36. The antenna system of claim 35, wherein the switch driver periodically cycles through a first state in which the first monopole antenna is selected, a second state in which both the first and second monopole antennas are selected, a third state in which the second monopole antenna is selected, and a fourth state in which both the first and second monopole antennas are selected.

37. The antenna system of claim 36, wherein the switch circuit transitions from one state to a next relatively gradually during a transition time, wherein the transition time is greater than the characteristic reception interval.

38. The antenna system of claim 35, wherein the switch driver periodically cycles through a first state in which the first antenna is selected and a second state in which the second antenna is selected.

39. The antenna system of claim 38, wherein the switch circuit transitions from one state to a next relatively gradually during a transition time, wherein the transition time is greater than the characteristic reception interval.

40. The antenna system of claim 35, wherein the period of the switch driver is less than about 0.1 seconds.

41. The antenna system of claim 36, wherein each of said states is longer than three times the characteristic reception interval.

42. The antenna system of claim 41, wherein the period is less than about 0.1 seconds.

43. The antenna system of claim 42, wherein the characteristic reception interval is less than about 1.5 milliseconds.

44. The antenna system of claim 43, wherein the switch circuit transitions from one state to a next relatively gradually during a transition time, wherein the transition time is between about 2 and about 10 milliseconds.

45. The antenna system of claim 35, wherein the switch circuit includes a Wilkinson power divider to provide a summing junction.

* * * * *